US006877676B2

(12) United States Patent
Saner et al.

(10) Patent No.: US 6,877,676 B2
(45) Date of Patent: Apr. 12, 2005

(54) FIREFIGHTING NOZZLE

(75) Inventors: Mark S. Saner, Wooster, OH (US); Kevin J. Petit, Wooster, OH (US)

(73) Assignee: Premier Farnell, LLC, Cleveland, OH (US)

( * ) Notice: Subject to any disclaimer, the term of this patent is extended or adjusted under 35 U.S.C. 154(b) by 187 days.

(21) Appl. No.: 09/956,375

(22) Filed: Sep. 18, 2001

(65) Prior Publication Data

US 2003/0052191 A1 Mar. 20, 2003

(51) Int. Cl.[7] ..... B05B 1/28; B05B 15/08

(52) U.S. Cl. ..... 239/296; 239/291; 239/301; 239/587.3; 239/441

(58) Field of Search ..... 239/296, 291, 239/301, 300, 390, 391, 392, 439, 441, 443, 447, 449, 569, 587.3; 169/45, 70, 16, 57, 90

(56) References Cited

U.S. PATENT DOCUMENTS 2,342,050 A 2/1944 Hurst
2,389,642 A 11/1945 Schellin et al.
2,567,176 A 9/1951 Ballard
2,570,828 A 10/1951 Martin
2,675,270 A 4/1954 Clougherty et al.
2,753,219 A 7/1956 Matarese
2,760,826 A 8/1956 Allenbaugh
2,842,154 A 7/1958 Lindsley
4,176,794 A 12/1979 Allenbaugh, Jr.
4,358,058 A 11/1982 Bierman
4,949,794 A 8/1990 Petit et al.
5,261,494 A 11/1993 McLoughlin et al.
5,447,203 A 9/1995 McLoughlin et al.
5,590,719 A 1/1997 McLoughlin et al.
6,089,474 A 7/2000 Marino

*Primary Examiner*—Davis Hwu
(74) *Attorney, Agent, or Firm*—Jones Day

(57) ABSTRACT

A firefighting nozzle capable of selectively producing only a solid stream, only a fog pattern or a combination of both. The passage for the fog liquid can be opened to a flushing position for flushing debris therefrom. A solid stream sleeve is removably attached to a nozzle body for allowing discharge of solid streams having different diameters. A valve ball having primary and secondary flow passages is movable to positions for supplying liquid therethrough to both solid stream and annular fog supply passages, or to only the annular fog supply passage while closing the solid stream passage.

68 Claims, 5 Drawing Sheets

FIREFIGHTING NOZZLE

BACKGROUND OF THE INVENTION

This application relates to the art of nozzles and, more particularly, to nozzles that are capable of producing a solid stream, a fog pattern or a combination of both. The nozzle of the present application is particularly suited for use in firefighting and will be described with particular reference thereto. However, it will be appreciated that at least certain features of the nozzle may have broader applications and uses.

Nozzles that selectively can produce a solid stream, a fog pattern or a combination of the two cannot easily be converted to produce solid streams of different diameters, are prone to clogging by debris and cannot produce effective or variable fog patterns. It would be desirable to have a combination nozzle that alleviates these deficiencies.

SUMMARY OF THE INVENTION

A firefighting nozzle of the type described that is capable of producing a solid stream, a fog pattern or both includes a flushing feature for flushing the fog liquid supply passage, a conversion feature for selectively providing solid streams of different diameters, and a feature for providing fog patterns that are both effective and variable.

The nozzle of the present application includes a valve ball having primary and secondary flow passages. In one ball position, liquid flows through the primary flow passage to a solid stream passage and out through the secondary flow passage to an annular fog liquid supply passage. In another ball position, the solid stream passage is closed while liquid flows into the secondary flow passage and out the primary flow passage to the annular fog liquid supply passage.

The nozzle of the present application includes a replaceable solid stream sleeve that is readily replaceable so that solid streams of different diameters and reach can be projected from the nozzle.

In accordance with the present application, a movable discharge sleeve in the passage that supplies fog liquid is movable to a flushing position in which the outlet from the passage is wide open so that debris can be flushed from the passage and outlet.

In accordance with another aspect of the application, a pattern sleeve is adjustable to vary the outward spread of the fog pattern and to bring a turbine ring into action for more thorough dispersal of the fog pattern.

It is a principal object of the present invention to provide improvements to a firefighting nozzle that is capable of producing a solid stream, a fog pattern or a combination of both.

It is another object of the invention to provide such a nozzle with a valve ball having primary and secondary flow passages for providing both solid stream and fog liquid or only fog liquid in different positions of the ball.

It is another object of the invention to provide such a nozzle with a flushable passage for the fog producing liquid.

It is a further object of the invention to provide such a nozzle having a replaceable solid stream sleeve to enable projection of solid streams having different diameters and reach.

It is also an object of the invention to provide such a nozzle with an adjustable fog pattern and with a dispersable feature for providing high dispersal of the fog liquid.

It is an additional object of the invention to provide such a nozzle that is relatively economical and simple to manufacture, assemble and repair.

DESCRIPTION OF A REPRESENTATIVE EMBODIMENT

Figure 1:
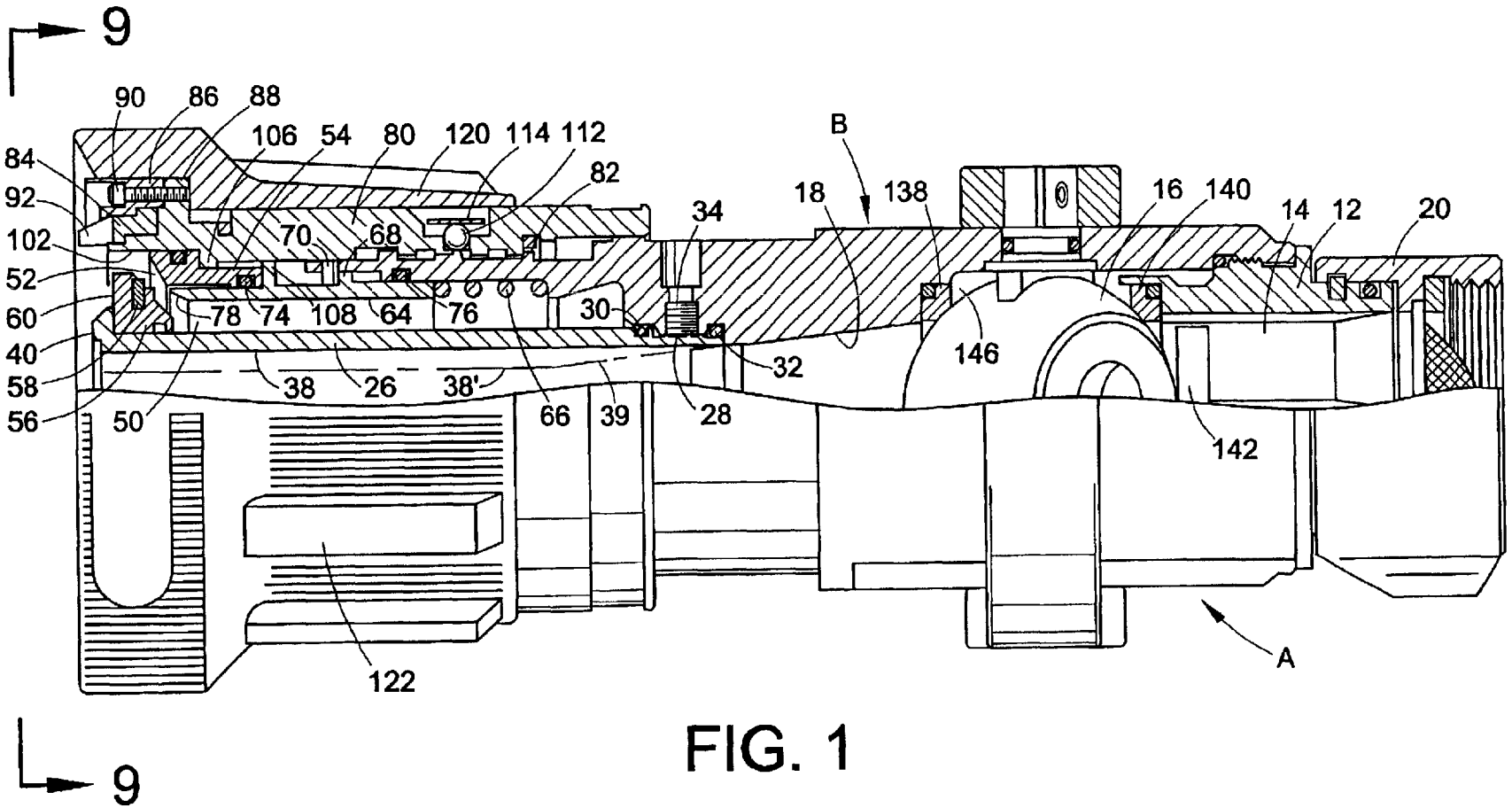
FIG. 1 is a side elevational view of a firefighting nozzle in accordance with the present application, and with portions cut-away and in section for clarity of illustration.

Referring now to the drawing, wherein the showings are for purposes of illustrating a representative embodiment of the invention only and not for purposes of limiting same, FIG. 1 shows a nozzle assembly A that includes a one-piece cast nozzle body B.

An inlet adapter 12 is secured to nozzle body B and has a liquid supply passage 14 on the upstream side of ball valve 16. A discharge passage 18 is provided in nozzle body B on the downstream side of ball valve 16. A coupling 20 is attached to inlet adapter 12 for connecting the nozzle assembly to a hose.

A cylindrical solid stream sleeve 26 is removably attached to nozzle body B by way of cooperating external threads on the sleeve and internal threads on the nozzle body as generally indicated at 28. Sealing rings 30, 32 are provided between the sleeve and nozzle body on opposite sides of the cooperating threads. A set screw 34 threaded into a suitable radial tapped hole in nozzle body B is engageable with the threads on solid stream sleeve 26 for releasably locking same in position.

Figure 9:
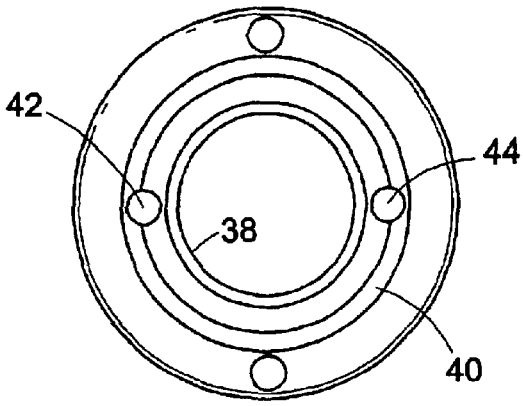
FIG. 9 is an end elevational view taken generally on line 9—9 of FIG. 1.

Solid stream sleeve 26 may be provided in a variety of different diameter solid stream passages 38 depending upon the application to be served by the nozzle assembly. As shown in FIG. 9, outer end face 40 of solid stream sleeve 26 has a pair of opposite recesses 42, 44 therein to receive a spanner wrench for rotating the sleeve to install or remove same. By way of example, shadow line 38' in FIG. 1 represents the inner surface of a different solid stream sleeve having a smaller diameter flow passage. The sleeves with smaller diameter flow passages have an entrance taper as generally indicated at 39 corresponding to the taper of discharge passage 18 while the remainder of the solid stream passage along a major portion of the sleeve length is cylindrical.

An annular discharge passage 50 surrounds solid bore sleeve 26 and has an annular outlet 52 between a throat ring 54 and a baffle ring 56. A gasket 58 is secured between baffle ring 56 and a gasket retainer ring 60. Gasket retainer ring 60 may be considered to be a fixed deflector while throat ring 54 is a movable fog pattern control member.

Throat ring 54 is received on an outer end portion of a discharge sleeve 64 that normally is biased to the left in FIG. 1 by a coil spring 66 to engage discharge sleeve abutment 68 with a stop pin 70 secured to nozzle body B. A sealing ring 74 is provided between throat ring 54 and discharge sleeve 64, and another sealing ring 76 is provided between the rear end portion of discharge sleeve 64 and nozzle body B.

The inner surface of discharge sleeve 64 has an outwardly curved or flared outer end portion 78 leading to annular outlet 52. The opposed surface of gasket retainer 60 likewise is inclined as shown in FIG. 1 to facilitate flow of liquid from annular passage 50 to outlet 52 by providing an annular transition passage for changing the direction of flow.

A pattern sleeve 80 is threaded on nozzle body B for longitudinal movement relative thereto upon rotation of the pattern sleeve. The cooperating inner threads on the pattern sleeve and the external threads on nozzle body B are generally indicated by numeral 82. A turbine ring 84 is rotatably trapped between the outer end of pattern sleeve 80 and a turbine ring retainer 86 attached to an outwardly extending flange 88 on pattern sleeve 80 by plurality of fasteners 90. Turbine ring 84 has a plurality of circumferentially-spaced inclined vanes 92 thereon for providing rotation of turbine ring 84 when liquid strikes vanes 92.

In the position of the pattern sleeve shown in FIG. 1, an inner cylindrical surface 102 at the outer end portion of the pattern sleeve extends well beyond throat ring 54. Therefore, liquid flowing through annular outlet 52 from annular passage 50 strikes inner cylindrical surface 102 to produce an annular solid liquid discharge stream.

Pattern sleeve 80 is rotatable to move same rearwardly along nozzle body B so that the length of inner cylindrical surface 102 extending beyond throat ring 54 becomes progressively smaller. As the length of inner cylindrical surface 102 that extends beyond throat ring 54 becomes smaller, the liquid flowing through annular outlet 102 is dispersed outwardly in a progressively wider and more dispersed fog pattern instead of being in a solid annular stream.

Figure 2:
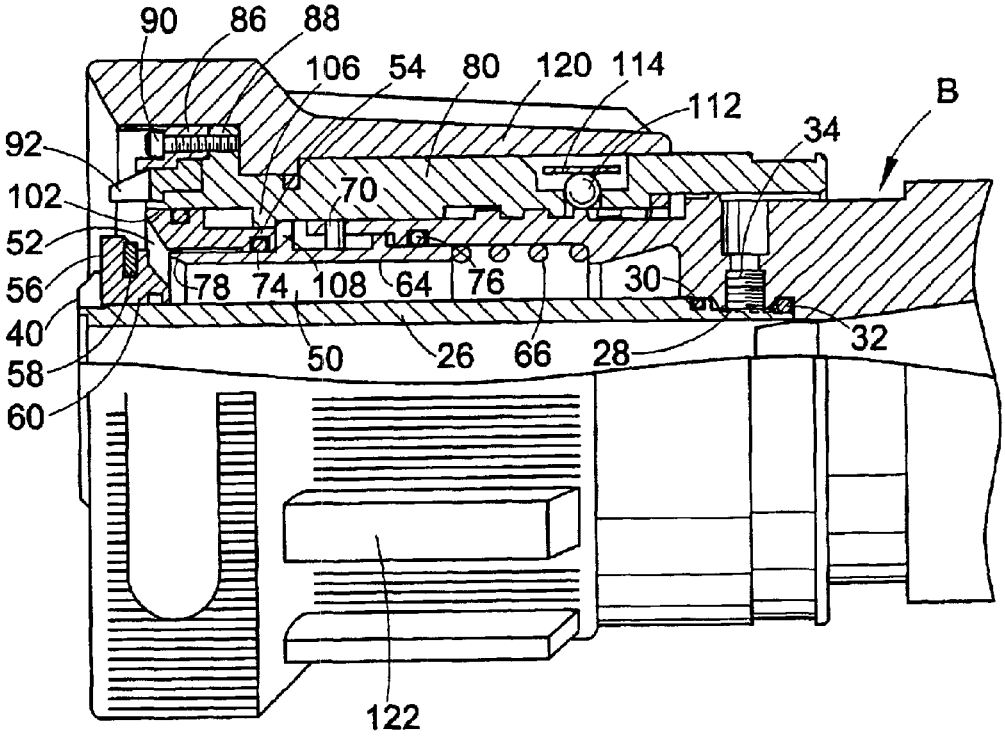
FIG. 2 is a partial view similar to FIG. 1 and showing a pattern sleeve in an alternative position.

Eventually, as shown in FIG. 2, cylindrical surface 102 is completely retracted clear of annular outlet 52 and vanes 92 on turbine ring 84 become aligned with outlet 52. The liquid striking the vanes causes further dispersal of the liquid and also causes rotation of the turbine ring to further disperse the liquid into a highly scattered fog pattern.

Figure 4:
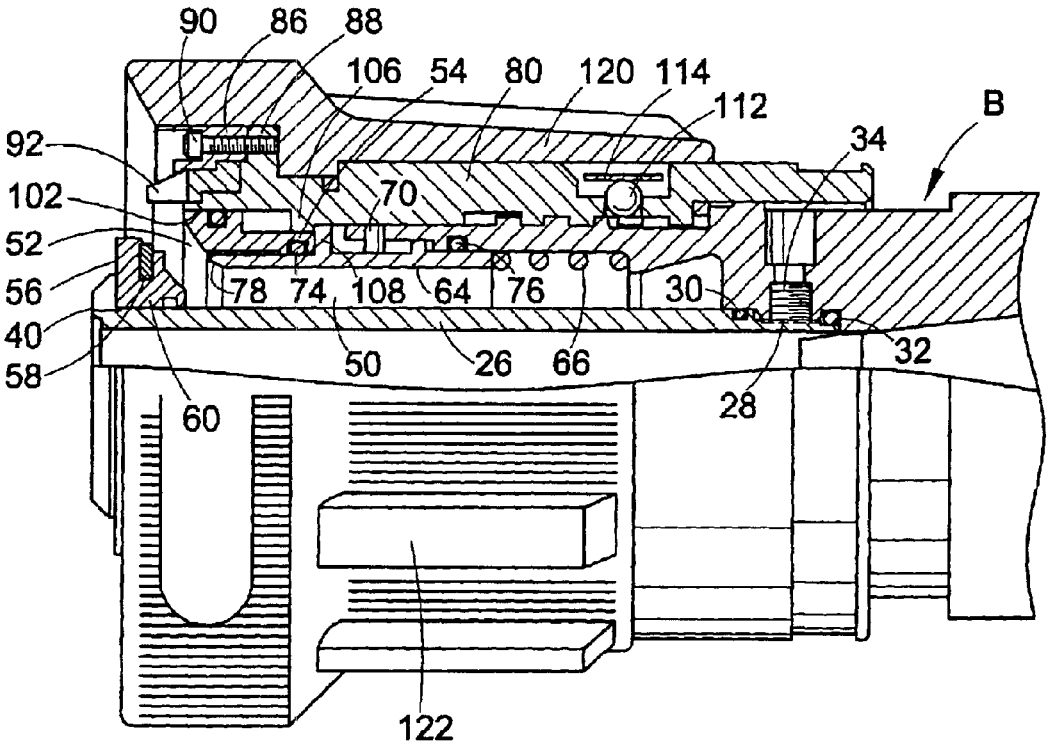
FIG. 4 is a view similar to FIG. 3 and showing the pattern sleeve in a clean-out position for flushing an annular passage through which liquid flows for producing fog.
Figure 5:
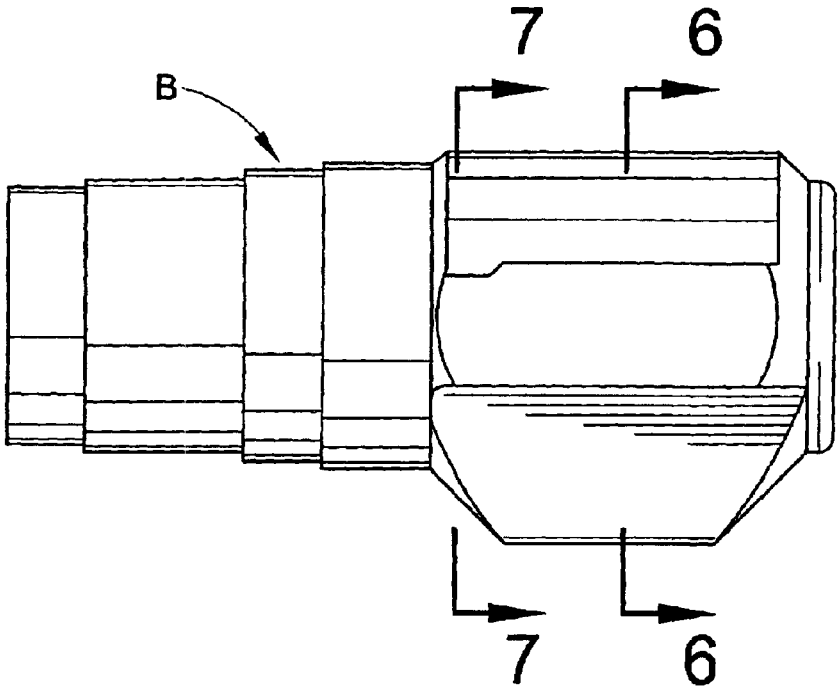
FIG. 5 is a side elevational view of a nozzle body casting used in the firefighting nozzle of FIGS. 1–4.
Figure 6:
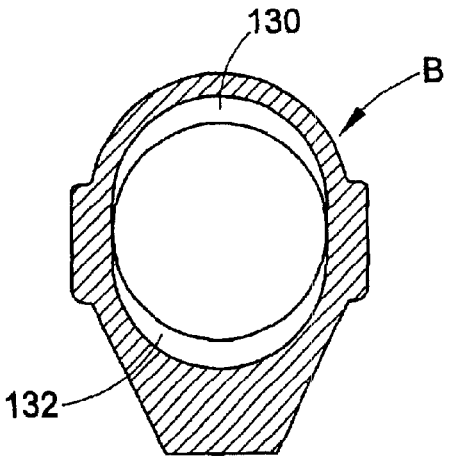
FIG. 6 is a cross-sectional elevational view taken generally on line 6—6 of FIG. 5.
Figure 7:
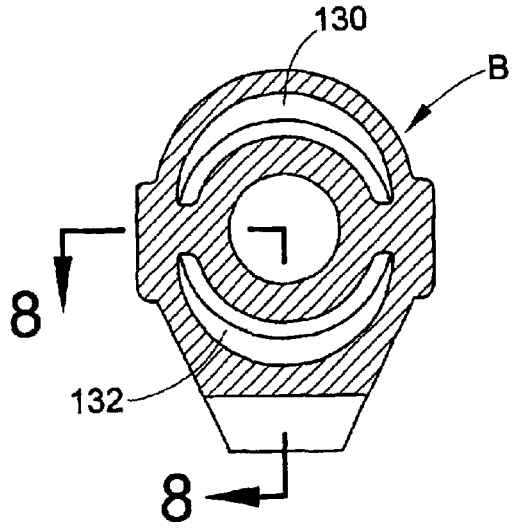
FIG. 7 is a cross-sectional elevational view taken generally on line 7—7 of FIG. 5.

Further rearward movement of pattern sleeve 80 causes an inwardly extending projection 106 on pattern sleeve 80 to engage an outwardly extending projection 108 on discharge sleeve 64 to move same rearwardly to the flushing position shown in FIG. 4 wherein outlet opening 52 is much larger than normal for flushing debris from discharge passage 50 and annular outlet 52.

Figure 3:
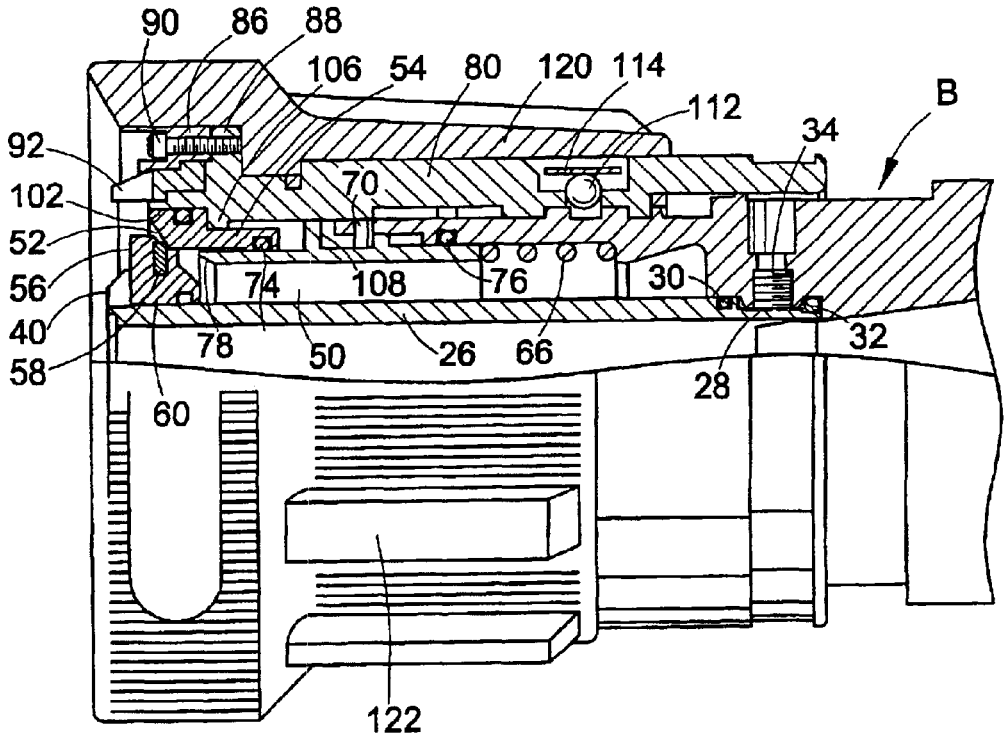
FIG. 3 is a view similar to FIG. 2 and showing the pattern sleeve in a different position for closing an annular outlet.

Movement of pattern sleeve 80 in a direction outwardly along nozzle body B from the position shown in FIG. 1 gradually reduces the size of annular outlet 52 and eventually closes the annular outlet 52 as shown in FIG. 3 by engagement of the inclined outer surface of throat ring 54 with gasket 58.

One or more balls 112 received in a suitable hole in pattern sleeve 80 engage a plurality of circumferentially-spaced detents in the exterior surface of nozzle body B. A spring band 114 extending around the nozzle body biases the ball inwardly into the detents to provide releasable holding of the pattern sleeve in a desired adjusted position and to produce a clicking action when the pattern sleeve is rotated. As elastomeric bumper 120 secured to pattern sleeve 80 has a plurality of circumferentially-spaced outwardly projecting lugs 122 thereon to facilitate gripping of the bumper for rotating same along with pattern sleeve 80.

Figure 8:
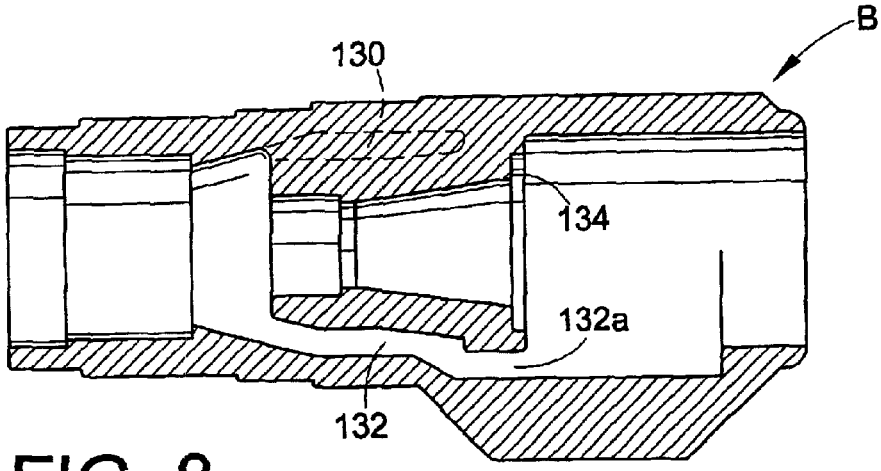
FIG. 8 is a cross-sectional elevational view taken generally on line 8—8 of FIG. 7.

The flow passages within the nozzle body B for supplying liquid to annular passage 50 are shown with reference to FIGS. 5–8. Internal flow passages 130, 132 have inlets on the downstream side of ball valve 16 and only one of such inlets is shown at 132*a* for flow passage 132. The interior of nozzle body B has a circumferential recess 134 outwardly of inlets 132*a* as shown in FIG. 8. Recess 134 receives a downstream seal 138 in FIG. 1 on the downstream side of ball valve 16. An upstream ball valve seal 140 is carried by inlet adapter 12. Circumferentially-spaced lateral bypass openings 142 in inlet adapter 12 on the upstream side of ball valve 16 extend radially of the nozzle axis and allow liquid to flow outwardly past upstream seal 140 around the exterior of ball valve 16 through bypass passages 146 to enter the inlets 132*a* to passages 130, 132 located radially outwardly of ball valve seal 138.

Figure 10:
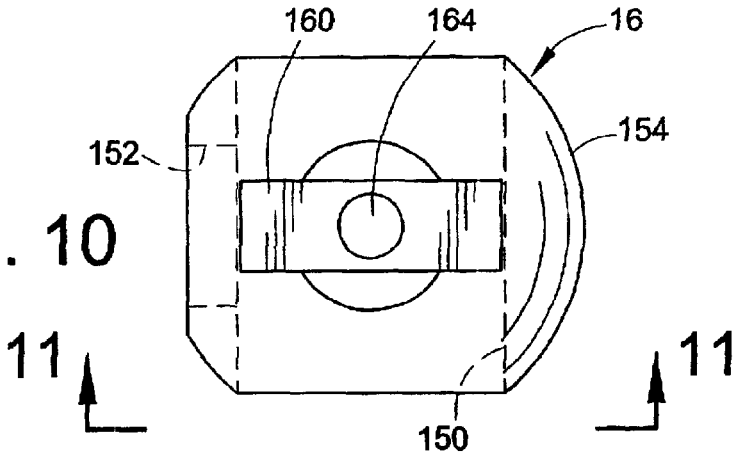
FIG. 10 is a top plan view of a ball used in the ball valve of the present application;.
Figure 11:
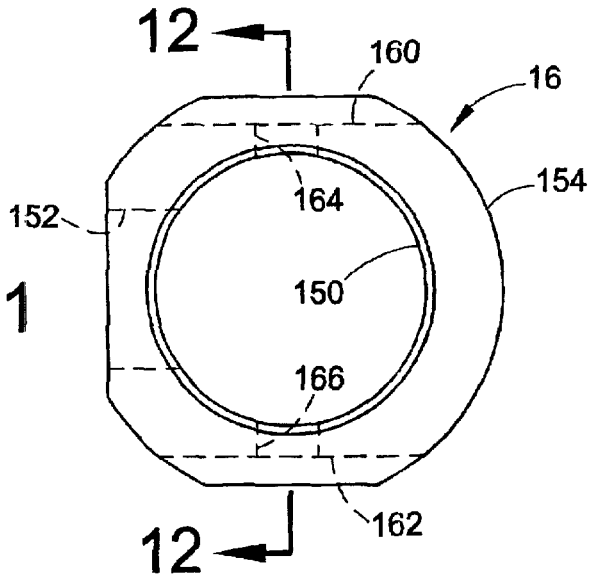
FIG. 11 is a side elevational view of the ball of FIG. 10 taken generally on line 11—11 of FIG. 10.
Figure 12:
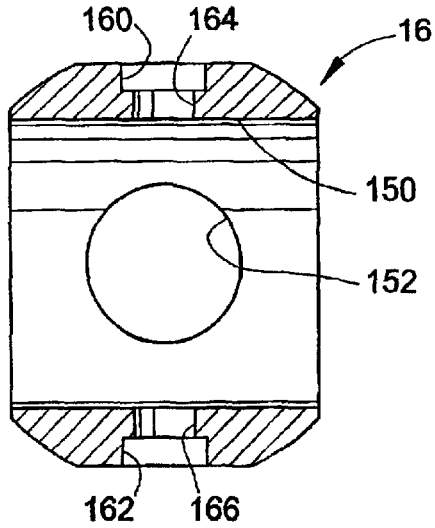
FIG. 12 is a cross-sectional elevational view taken generally on line 12—12 of FIG. 11.

FIGS. 10–12 show generally spherical valve ball 16 having a cylindrical primary flow passage 150 therethrough. A cylindrical secondary flow passage 152 extends through only one side of the ball and intersects primary flow passage 150 at the midpoint thereof. Thus, the ball has three openings on its external surface through which liquid flows. The axes of passages 150, 152 intersect perpendicular to one another.

Primary flow passage 150 is much larger than secondary flow passage 152. By way of example, primary flow passage 150 may have a diameter of around 1.4 inch while secondary flow passage 152 has a diameter of around 0.75 inch.

A spherically curved external surface area 154 on ball 16 is adapted to cooperate with seal 138 of FIG. 1 to close solid stream passage 18.

Grooves 160, 162 and holes 164, 166 in ball 16 are provided for rotatably mounting the ball on the nozzle body and attaching a handle thereto for moving same between alternate positions.

In a combined supply position of ball 16, primary flow passage 150 is aligned with supply and solid stream passages 14, 18, while secondary flow passage 152 communicates between primary flow passage 150 and annular passage 50 by way of bypass passage 146, internal flow passages 130, 132 and inlets 132*a* in nozzle body B. Annular outlet 52 may be closed so that all of the liquid will be discharged through solid stream passage 18, or may be open to produce fog in combination with the solid stream.

In another position of valve ball 16 that is rotatably displaced 90° from the above described position, secondary flow passage 152 is aligned with supply passage 14 while the opposite open ends of primary flow passage 150 communicate with annular passage 50 by way of bypass passage 146, internal passages 130, 132 and inlets 132*a* in nozzle body B. In this position of the ball, solid stream passage 18 is closed by cooperation of seal 138 with ball area 154. All of the liquid now is supplied for discharge through annular fog liquid outlet 52.

In the combined supply position of ball 16, liquid flows into one open end of primary flow passage 150 from supply passage 14 and flows out of the other open end of primary flow passage 150 to solid stream passage 18. In this position, liquid flows out of secondary flow passage 152 to bypass passage 146 where it flows through nozzle body internal passages 130, 132 to annular passage 50. Liquid is discharged from annular passage depending on whether annular outlet 52 is open.

In the other position of ball 16, liquid flows into secondary flow passage 152 from supply passage 14 and flows out through the opposite open ends of primary flow passage 150 to bypass passage 146 where it may flow through nozzle body internal passages 130, 132 to annular passage 50. In this position of ball 16, solid stream passage 18 is closed by the ball and liquid will be discharged from annular passage 50 depending on whether annular outlet 52 is open. The discharge pattern from annular outlet 52 is variable by adjustment of pattern sleeve 80.

Bypass passage 146 externally of ball 16 communicates between annular discharge passage 50 and supply passage 14 by way of openings 142 in the supply passage and internal passages 130, 132 in nozzle body B.

Although the invention has been shown and described with reference to a representative embodiment, it is obvious that alterations and modifications will occur to others skilled in the art upon the reading and understanding of this application. Therefore, it is to be understood that the invention may be practiced otherwise than as specifically described herein while remaining within the scope of the claims.

We claim:

1. A firefighting nozzle comprising:

a nozzle body having a valve with upstream and downstream sides;

said nozzle body having a liquid supply passage on said upstream side of said valve;

said nozzle body having a solid stream passage and an annular passage on said downstream side of said valve;

said supply and solid stream passages being generally axially aligned and said annular passage being in generally coaxial surrounding relationship with said solid stream passage;

said valve including a valve ball having a passageway therethrough;

said ball passageway being configured to provide flow therethough to both said solid stream and annular passages in one position of said ball and to provide flow therethrough only to said annular passage in another position of said ball in which said solid stream passage is closed;

said ball having one position in which liquid flows from said supply passage directly into and through said ball passageway to both said solid stream and annular passages; and, ball having another position in which said solid stream passage is closed and liquid flows from said supply passage directly into and through said ball passageway only to said annular passage.

2. The nozzle of claim 1 including a valve bypass passage communicating between said supply passage and said annular passage around said ball, said supply passage being in an inlet adapter attached to said nozzle body, and said inlet adapter having a bypass opening communicating with said bypass passage.

3. The nozzle of claim 2 wherein said nozzle body has a longitudinal axis and said bypass opening extends radially of said axis.

4. The nozzle of claim 2 including upstream and downstream valve ball seals cooperating with said ball, said annular flow passage being radially outwardly of said downstream seal, said bypass passage providing flow from said supply passage past said upstream seal and externally of said ball to said annular passage.

5. The nozzle of claim 1 wherein said ball passageway through which liquid flows from said supply passage to said solid stream passage is centrally located in said ball and is coaxial with said supply and solid stream passages when said ball is in said position to provide flow therethrough from said supply passage to said solid stream passage.

6. The nozzle of claim 1 including an outwardly inclined annular outlet from said annular flow passage, and a plurality of circumferentially-spaced fog forming vanes spaced outwardly from said outlet for dispersing liquid flowing from said annular outlet.

7. A firefighting nozzle comprising:

a nozzle body having a solid stream flow passage and an annular flow passage surrounding said solid stream flow passage;

said annular flow passage including an axially movable discharge sleeve;

said annular flow passage having an annular outlet to which liquid flows through said discharge sleeve; and a pattern sleeve on said nozzle body outwardly of said annular outlet for varying the discharge pattern of liquid flowing through said outlet.

8. The nozzle of claim 7 wherein said discharge sleeve is biased axially outward against a stop on said nozzle body to provide a normal position for said discharge sleeve, said discharge sleeve being movable axially inward by operation of said pattern sleeve to enlarge the size of said annular opening for flushing said annular passage.

9. The nozzle of claim 7 wherein said annular outlet is defined between an inner baffle ring and an outer throat member that is slidably received on said discharge tube.

10. The nozzle of claim 7 wherein said pattern sleeve includes a rotatable turbine ring alignable with the liquid discharge from said annular outlet to disperse the liquid in a fog pattern.

11. The nozzle of claim 7 wherein said solid stream flow passage is through a solid stream sleeve removably attached to said nozzle body.

12. A firefighting nozzle comprising:

a nozzle body having a valve therein, said valve having upstream and downstream sides and being movable between open and closed positions;

an inlet passage on said upstream side of said valve;

a discharge passage on said downstream side of said valve; and a solid stream sleeve removably attached to said nozzle body in communication with said discharge passage, whereby solid stream sleeves of different sizes are attachable to said nozzle body for discharging solid streams of different diameters.

13. The nozzle of claim 12 wherein said solid stream sleeve is removably threaded to said nozzle body internally thereof.

14. The nozzle of claim 12 including a setscrew on said nozzle body engageable with said solid stream sleeve to releasably lock said solid stream sleeve to said nozzle body.

15. The nozzle of claim 12 including an annular discharge passage surrounding said solid stream sleeve.

16. The nozzle of claim 15 including a discharge sleeve in said annular discharge passage, said discharge sleeve being biased to a position that provides a normal annular outlet opening from said annular discharge passage, and said annular discharge sleeve being retractable to enlarge said annular outlet opening for flushing said annular discharge passage.

17. The nozzle of claim 16 including a gasket carried by said solid stream sleeve on one side of said annular outlet opening and a throat member carried by said annular discharge sleeve on the other side of said annular outlet opening, said throat member being movable into engagement with said gasket for closing said annular outlet opening.

18. The nozzle of claim 17 including a pattern sleeve adjustably mounted to said nozzle body for movement longitudinally thereof to vary the pattern of liquid discharged from said annular outlet opening and for retracting said annular discharge sleeve.

19. A firefighting nozzle comprising:

a nozzle body having a valve therein;

said nozzle body having a liquid supply passage upstream of said valve;

said nozzle body having solid stream and annular passages downstream of said valve;

said supply and solid stream passages being generally axially aligned and said annular passage being in generally coaxial surrounding relationship with said solid stream passage;

said valve including a ball having a ball passageway therethrough;

said ball being selectively movable for supplying liquid through said ball passageway to both said solid stream and annular passages simultaneously from said supply passage or for supplying liquid through said ball passageway only to said annular passage from said supply passage while closing said solid stream passage; and a bypass passage around said ball between said supply passage and said annular passage.

20. A firefighting nozzle comprising:

a nozzle body having a ball valve therein, said valve including a valve ball;

said nozzle body having a liquid supply passage upstream of said valve;

said nozzle body having solid stream and annular passages downstream of said valve;

said valve ball being selectively movable to a combined supply position for supplying liquid to both said solid stream and annular passages simultaneously;

said ball being selectively movable to a single supply position for supplying liquid only to said annular passage while closing said solid stream passage;

said valve ball having primary and secondary flow passages;

said valve ball in said combined supply position thereof having said primary flow passage aligned with said supply and solid stream passages while said secondary flow passage communicates between said primary flow passage and said annular passage;

said valve ball in said single supply position having said secondary flow passage aligned with said supply passage while said solid stream passage is closed and said primary flow passage communicates between said secondary flow passage and said annular passage.

21. The nozzle of claim 20 including a bypass passage around said valve ball between said supply passage and said annular passage.

22. The nozzle of claim 20 wherein said primary flow passage in said valve ball is larger than said secondary flow passage in said valve ball.

23. A firefighting nozzle comprising:

a nozzle body having a valve with upstream and downstream sides;

an inlet adapter attached to said nozzle body on said upstream side of said valve;

said inlet adapter having a liquid supply passage;

said nozzle having a solid stream passage and an annular passage on said downstream side of said valve;

a bypass passage around said valve between said supply passage and said annular passage;

said inlet adapter having at least one bypass opening communicating between said supply passage and said bypass passage;

said valve having one position in which liquid flows to said solid stream passage from said supply passage and to said annular passage from said supply passage, said bypass opening and said bypass passage; and said valve having another position in which said solid stream passage is closed and liquid flows only to said annular passage.

24. The nozzle of claim 23 wherein said valve is a ball valve having a one-piece ball.

25. The nozzle of claim 23 including flow passages integrally formed within said nozzle body communicating between said bypass passage and said annular passage.

26. The nozzle of claim 23 wherein said valve includes a valve ball having a ball passageway that is configured to provide flow directly therethrough from said supply passage to said bypass passage in at least one of said valve positions.

27. The nozzle of claim 23 wherein said valve includes a valve ball having a ball passageway that is configured to provide flow directly therethrough from said supply passage to said bypass passage in both of said valve positions.

28. The nozzle of claim 23 wherein said solid stream passage is through a solid stream sleeve threadably attached to said nozzle body.

29. A firefighting nozzle comprising:

a nozzle body having a valve with upstream and downstream sides;

a liquid supply passage on said upstream side of said valve;

a solid stream discharge passage and an annular discharge passage on said downstream side of said valve;

said supply and solid stream passages being generally axially aligned and said annular passage being in generally coaxial surrounding relationship with said solid stream passage;

said valve including a valve ball having a ball passageway therethrough;

said ball having one position in which liquid flows from said supply passage directly into and through said ball passageway to said solid stream discharge passage; and said ball having another position in which said solid stream discharge passage is closed and liquid flows from said supply passage directly into and through said ball passageway only to said annular discharge passage.

30. The nozzle of claim 29 wherein said ball passageway is centrally located in said ball and is coaxial with said supply and solid stream passages when said ball is in said position to provide flow therethrough from said supply passage to said solid stream passage.

31. The nozzle of claim 29 wherein said ball passageway is configured such that in at least one of said ball positions said ball passageway has a ball inlet into which liquid flows directly from said supply passage and a ball passageway outlet from which liquid flows to said annular discharge passage, and said ball passageway inlet being larger than said ball passage outlet.

32. A firefighting nozzle having a solid stream discharge passage and an annular discharge passage surrounding said solid stream flow passage;

said annular discharge passage having an annular outlet;

said annular outlet being between a fixed deflector and an axially movable fog pattern control member; and said fog pattern control member being axially movable toward and away from said deflector to vary the size of said annular outlet and vary the fog pattern produced by liquid flowing through said annular outlet.

33. The nozzle of claim 32 wherein said fog pattern control member is carried by a rotatable pattern sleeve that moves axially of said nozzle responsive to rotation thereof to vary the spacing between said deflector and said fog pattern control member.

34. The nozzle of claim 32 wherein said solid stream discharge passage is in a solid stream sleeve that is threadably attached to said nozzle body.

35. The nozzle of claim 34 wherein said fixed deflector is on an end portion of said solid stream sleeve.

36. The nozzle of claim 32 including a plurality of circumferentially-spaced fog forming vanes adjacent said annular outlet for dispersing liquid flow from said annular outlet.

37. The nozzle of claim 36 wherein said vanes are on a rotatable turbine ring.

38. A firefighting nozzle comprising:

a nozzle body having a valve with upstream and downstream sides;

a liquid supply passage on said upstream side of said valve;

said nozzle body having a solid stream discharge sleeve threadably attached thereto on said downstream side of said valve;

an annular discharge passage surrounding said solid stream discharge sleeve;

said solid stream discharge sleeve having an outer end portion;

a deflector member mounted on said outer end portion of said solid stream discharge sleeve externally thereof and extending outwardly therefrom;

a throat member axially movable toward and away from said deflector member;

said deflector member and said throat member being positioned in cooperative relationship and forming an annular discharge opening therebetween from said annular passage;

said throat member being movable toward and away from said deflector member to vary the size of said annular discharge opening and being movable into engagement with said deflector member to close said annular discharge opening.

39. The nozzle of claim 38 including a pattern sleeve rotatable relative to said nozzle body and cooperating with said throat member to provide axial movement of said throat member in response to rotational movement of said pattern sleeve.

40. The nozzle of claim 39 wherein said deflector member and said throat member are configured to provide an outwardly dispersed discharge pattern from said annular discharge opening.

41. A firefighting nozzle comprising:

a nozzle body having a ball valve with upstream and downstream sides;

a liquid supply passage on said upstream side of said valve;

solid stream and annular discharge passages on said downstream side of said valve;

said supply and solid stream passages being generally axially aligned and said annular passage being in generally coaxial surrounding relationship with said solid stream passage;

said ball valve having a ball with a ball passageway that is configured to provide flow therethrough from said supply passage to said annular passage in one position of said ball in which said solid stream discharge passage is closed by said ball and to provide flow therethrough from said supply passage to said solid stream discharge passage in another position of said ball; and, said ball passageway being positioned so that liquid flows from said supply passage directly into said ball passageway in both of said positions of said ball.

42. The nozzle of claim 41 wherein said supply passage is in an inlet adapter attached to said nozzle body, a bypass passage around said ball to said annular discharge passage, and said inlet adapter having a bypass opening communicating with said bypass passage.

43. The nozzle of claim 41 wherein said supply and solid stream passages are coaxial and said ball passageway is centrally located in said ball, and said ball passageway being coaxial with said supply and solid stream passages when said ball is in said position to provide flow therethrough from said supply passage to said solid stream passage.

44. A firefighting nozzle comprising:

a nozzle body having a valve with upstream and downstream sides;

said nozzle body having a liquid supply passage on said upstream side of said valve;

said nozzle body having a solid stream passage and an annular passage on said downstream side of said valve;

said valve having one position in which liquid flows through said valve to both said solid stream and annular passages from said supply passage and said valve having another position in which said solid stream passage is closed and liquid flows through said valve only to said annular passage from said supply passage;

an outwardly inclined annular outlet from said annular flow passage;

said annular outlet being between a fixed deflector and a movable fog pattern control member; and said fog pattern control member being movable into engagement with said deflector to close said outlet and being movable away from said deflector to vary the size of said outlet and vary the fog pattern produced by liquid flowing through said outlet.

45. The nozzle of claim 44 wherein said fog pattern control member is carried by a rotatable pattern sleeve that moves axially of said nozzle body responsive to rotation thereof to vary the spacing between said deflector and said fog pattern control member.

46. The nozzle of claim 45 including a tubular discharge member in said annular flow passage, said tubular discharge member being biased in a direction toward said outlet and having an outwardly flared end portion adjacent said outlet.

47. A firefighting nozzle comprising:

a nozzle body having a valve with upstream and downstream sides;

said nozzle body having a liquid supply passage on said upstream side of said valve;

said nozzle body having a solid stream passage and an annular passage on said downstream side of said valve;

said valve having one position in which liquid flows through said valve to both said solid stream and annular passages from said supply passage and said valve having another position in which said solid stream passage is closed and liquid flows through said valve only to said annular passage from said supply passage;

said valve comprising a ball valve having a ball with primary and secondary flow passages;

said ball having one position in which said primary flow passage is aligned with said liquid supply passage and with said solid stream passage; and said ball having another position in which said secondary flow passage in said ball is aligned with said liquid supply passage and said solid stream flow passage is closed so that liquid from said liquid supply passage flows into said secondary flow passage in said ball and out said primary flow passage to said annular flow passage.

48. The nozzle of claim 47 wherein said primary flow passage extends centrally through said ball and said secondary flow passage intersects said primary flow passage.

49. The nozzle of claim 47 wherein said primary flow passage is larger than said secondary flow passage.

50. A firefighting nozzle comprising:

a nozzle body having a valve therein;

said nozzle body having a liquid supply passage upstream of said valve;

said nozzle body having solid stream and annular passages downstream of said valve;

said valve being selectively movable for supplying liquid to both said solid stream and annular passages simultaneously or for supplying liquid only to said annular passage while closing said solid stream passage;

a bypass passage around said valve between said supply passage and said annular passage;

said valve including a valve ball having primary and secondary flow passages;

said primary flow passage being aligned with said supply and solid stream passages when said ball is positioned for supplying liquid to both said solid stream and annular passages so that liquid flows out said secondary flow passage to said annular passage; and said secondary flow passage being aligned with said supply passage when said ball is in a position closing said solid stream passage so that liquid flows into said secondary flow passage and out said primary flow passage to said annular passage.

51. A firefighting nozzle comprising:

a nozzle body having a valve with upstream and downstream sides;

an inlet adapter attached to said nozzle body on said upstream side of said valve;

said inlet adapter having a liquid supply passage;

said nozzle having a solid stream passage and an annular passage on said downstream side of said valve;

a bypass passage around said valve between said supply passage and said annular passage;

said inlet adapter having at least one bypass opening communicating between said supply passage and said bypass passage;

said valve having one position in which liquid flows to said solid stream passage from said supply passage and to said annular passage from said supply passage, said bypass opening and said bypass passage;

said valve having another position in which said solid stream passage is closed and liquid flows only to said annular passage;

said valve being a ball valve having a ball with primary and secondary flow passages;

said ball in said one position of said valve providing flow through said primary flow passage from said supply passage to said solid stream passage and providing flow to said bypass passage through said secondary passage from said primary passage;

said ball in said other position of said valve providing flow through said primary flow passage to said bypass passage from said secondary flow passage and said supply passage.

52. A firefighting nozzle comprising:

a nozzle body having a valve with upstream and downstream sides;

an inlet adapter attached to said nozzle body on said upstream side of said valve; said inlet adapter having a liquid supply passage;

said nozzle having a solid stream passage and an annular passage on said downstream side of said valve;

a bypass passage around said valve between said supply passage and said annular passage;

said inlet adapter having at least one bypass opening communicating between said supply passage and said bypass passage;

said valve having one position in which liquid flows to said solid stream passage from said supply passage and to said annular passage from said supply passage, said bypass opening and said bypass passage;

said valve having another position in which said solid stream passage is closed and liquid flows only to said annular passage;

an outwardly inclined annular outlet from said annular flow passage;

said outlet being between a fixed deflector and a movable fog pattern control member; and said fog pattern control member being movable toward and away from said deflector to vary the size of said outlet and vary the fog pattern produced by liquid flowing through said outlet.

53. The nozzle of claim 52 wherein said fog pattern control member is movable into engagement with said deflector to close said outlet.

54. The nozzle of claim 52 including a plurality of circumferentially-spaced fog forming vanes adjacent said annular outlet for engaging and dispersing liquid flowing from said annular outlet.

55. The nozzle of claim 54 wherein said vanes are on a rotatable turbine ring.

56. A firefighting nozzle comprising:

a nozzle body having a valve with upstream and downstream sides;

a liquid supply passage on said upstream side of said valve;

a solid stream discharge passage and an annular discharge passage on said downstream side of said valve;

said valve having one position in which liquid flows through said valve to said solid stream discharge passage from said supply passage;

said valve having another position in which said solid stream discharge passage is closed and liquid flows through said valve only to said annular discharge passage from said supply passage;

an outwardly inclined annular outlet from said annular flow passage;

said outlet being between a fixed deflector and a movable fog pattern control member; and said fog pattern control member being movable toward and away from said deflector to vary the size of said outlet and vary the fog pattern produced by liquid flowing through said outlet.

57. The nozzle of claim 56 wherein said fog pattern control member is movable into engagement with said deflector to close said annular outlet.

58. The nozzle of claim 57 including an axially movable discharge sleeve inwardly of said pattern control member, said discharge sleeve being biased axially in a direction toward said outlet and having an end portion adjacent said outlet, and said discharge sleeve being movable axially in a direction away from said outlet by operation of said pattern control member to enlarge the size of said annular opening for flushing said annular passage.

59. A firefighting nozzle comprising:

a nozzle body having a ball valve with upstream and downstream sides;

a liquid supply passage on said upstream side of said valve;

solid stream and annular discharge passages on said downstream side of said valve;

a bypass passage around said valve to said annular discharge passage;

said ball valve having a ball with a ball passage that is configured to provide flow therethrough from said supply passage to said bypass passage in one position of said ball in which said solid stream discharge passage is closed by said ball and to provide flow therethrough from said supply passage to said solid stream discharge passage in another position of said ball;

said supply passage being in an inlet adapter attached to said nozzle body, said inlet adapter having a bypass opening communicating with said bypass passage;

upstream and downstream seals engaging said ball;

said upstream seal being carried by said inlet adapter; and said bypass opening providing communication between said supply passage and said bypass passage outwardly of said upstream seal.

60. A firefighting nozzle comprising:

a nozzle body having a ball valve with upstream and downstream sides;

a liquid supply passage on said upstream side of said valve;

solid stream and annular discharge passages on said downstream side of said valve;

a bypass passage around said valve to said annular discharge passage;

said ball valve having a ball with a ball passage that is configured to provide flow therethrough from said supply passage to said bypass passage in one position of said ball in which said solid stream discharge passage is closed by said ball and to provide flow therethrough from said supply passage to said solid stream discharge passage in another position of said ball;

said supply passage being in an inlet adapter attached to said nozzle body, said inlet adapter having a bypass opening communicating with said bypass passage;

an outwardly inclined annular outlet from said annular discharge passage, said outlet being between a fixed deflector and a movable fog pattern control member; and said fog pattern control member being movable into engagement with said deflector to close said outlet and being movable away from said deflector to vary the size of said outlet and vary the fog pattern produced by liquid flowing through said outlet.

61. A firefighting nozzle comprising:

a nozzle body having a ball valve with upstream and downstream sides;

a liquid supply passage on said upstream side of said valve;

solid stream and annular discharge passages on said downstream side of said valve;

a bypass passage around said valve to said annular discharge passage;

said ball valve having a ball with a ball passage that is configured to provide flow therethrough from said supply passage to said bypass passage in one position of said ball in which said solid stream discharge passage is closed by said ball and to provide flow therethrough from said supply passage to said solid stream discharge passage in another position of said ball;

upstream and downstream seals engaging said ball;

said upstream seal being between said ball and said liquid supply passage; and said downstream seal being between said ball and said solid stream discharge passage.

62. The nozzle of claim 61 wherein said supply passage is in an inlet adapter attached to said nozzle body and said upstream seal is carried by said inlet adapter.

63. A firefighting nozzle comprising:

a nozzle body having a valve with upstream and downstream sides;

said nozzle body having a liquid supply passage on said upstream side of said valve;

said nozzle body having a solid stream passage and an annular passage on said downstream side of said valve;

said supply and solid stream passages being generally axially aligned and said annular passage being in generally coaxial surrounding relationship with said solid stream passage;

said valve having one position in which liquid flows to both said solid stream and annular passages from said supply passage and said valve having another position in which said solid stream passage is closed and liquid flows only to said annular passage from said supply passage;

an outwardly inclined annular outlet from said annular flow passage;

said annular outlet being between a fixed deflector and a movable fog pattern control member; and said fog pattern control member being movable into engagement with said deflector to close said outlet and being movable away from said deflector to vary the size of said outlet and vary the fog pattern produced by liquid flowing through said outlet.

64. The nozzle of claim 63 herein said fog pattern control member is carried by a rotatable pattern sleeve that moves axially of said nozzle body responsive to rotation thereof to vary the spacing between said deflector and said fog pattern control member.

65. The nozzle of claim 64 including a tubular discharge member in said annular flow passage, said tubular discharge member being biased in a direction toward said outlet and having an outwardly flared end portion adjacent said outlet.

66. A firefighting nozzle comprising:

a nozzle body having a valve with upstream and downstream sides;

said nozzle body having a liquid supply passage on said upstream side of said valve;

said nozzle body having a solid stream passage and an annular passage on said downstream side of said valve;

said supply and solid stream passages being generally axially aligned and said annular passage being in generally coaxial surrounding relationship with said solid stream passage;

said valve having one position in which liquid flows to said solid stream passage from said supply passage and said valve having another position in which said solid stream passage is closed and liquid flows only to said annular passage from said supply passage;

said valve comprising a ball valve having a ball with a ball flow passageway therethrough;

said ball flow passageway being configured so that in said one position of said valve liquid flows from said liquid supply passage directly into and through said ball flow passageway to said solid stream passage; and said ball flow passageway being configured so that in said other position of said valve said solid stream passage is closed and liquid flows from said liquid supply passage directly into and through said ball flow passageway to said annular passage.

67. A firefighting nozzle comprising:

a nozzle body having a ball valve with upstream and downstream sides;

a liquid supply passage on said upstream side of said valve;

solid stream and annular discharge passages on said downstream side of said valve;

said ball valve having a ball with a ball passageway that is configured to provide flow therethrough from said supply passage to said annular discharge passage in one position of said ball in which said solid stream discharge passage is closed by said ball and to provide flow therethrough from said supply passage to said solid stream discharge passage in another position of said ball;

upstream and downstream seals engaging said ball;

said upstream seal being between said ball and said liquid supply passage; and said downstream seal being between said ball and said solid stream discharge passage.

68. The nozzle of claim 67 wherein said supply passage is in an inlet adapter attached to said nozzle body and said upstream seal is carried by said inlet adapter.

* * * * *